US011737490B2

(12) United States Patent
Melia et al.

(10) Patent No.: US 11,737,490 B2
(45) Date of Patent: Aug. 29, 2023

(54) SMOKING ARTICLE MOUTHPIECE

(71) Applicant: Essentra Filter Products Development Co. Pte. Ltd., Singapore (SG)

(72) Inventors: Paul Melia, Bangkok (TH); Andorn Meesreedee, Bangkok (TH); Suwit Prommetta, Bangkok (TH); Noppon Verachiowchanchai, Bangkok (TH); Patrick Meredith, Auckland (NZ)

(73) Assignee: Essentra Filter Products Development Co. Pte. Ltd., Singapore (SG)

( * ) Notice: Subject to any disclaimer, the term of this patent is extended or adjusted under 35 U.S.C. 154(b) by 374 days.

(21) Appl. No.: 16/956,721

(22) PCT Filed: Dec. 20, 2018

(86) PCT No.: PCT/EP2018/086196
§ 371 (c)(1),
(2) Date: Jun. 22, 2020

(87) PCT Pub. No.: WO2019/122128
PCT Pub. Date: Jun. 27, 2019

(65) Prior Publication Data

US 2020/0397037 A1 Dec. 24, 2020

(30) Foreign Application Priority Data

Dec. 22, 2017 (GB) ..... 1721741

(51) Int. Cl.
*A24D 3/02* (2006.01)
*A24D 3/04* (2006.01)
(Continued)

(52) U.S. Cl.
CPC ..... *A24D 3/0279* (2013.01); *A24D 3/04* (2013.01); *A24D 3/10* (2013.01); *A24D 3/14* (2013.01)

(58) Field of Classification Search
CPC ... A24D 3/04; A24D 3/10; A24D 3/14; A24D 3/0279; A24D 1/04
See application file for complete search history.

(56) References Cited

U.S. PATENT DOCUMENTS 3,356,094 A 12/1967 Ellis
2015/0027454 A1 1/2015 Li
(Continued)

FOREIGN PATENT DOCUMENTS

EP 2548625 A1 1/2013
EP 2893820 7/2015
(Continued)

OTHER PUBLICATIONS

International Search Report and Written Opinion issued in International Application No. PCT/EP2018/086196, dated Dec. 20, 2018, 9 pages.
(Continued)

*Primary Examiner* — Michael J Felton
*Assistant Examiner* — Ronnie Kirby Jordan
(74) *Attorney, Agent, or Firm* — Sheppard Mullin Richter & Hampton LLP

(57) ABSTRACT

A mouthpiece or filter element comprising a longitudinally extending hollow rod of filtering material having inner and outer surfaces, the inner surface defining at least one longitudinally extending channel which extends along the full length of the mouthpiece or filter element, wherein the distance between the inner and outer surfaces is 1 mm or less, wherein the filtering material of the mouthpiece or filter element comprises a plasticiser, wherein the amount of plasticiser present in the filtering material is less than 21.5%.

15 Claims, 3 Drawing Sheets

Figure 1:
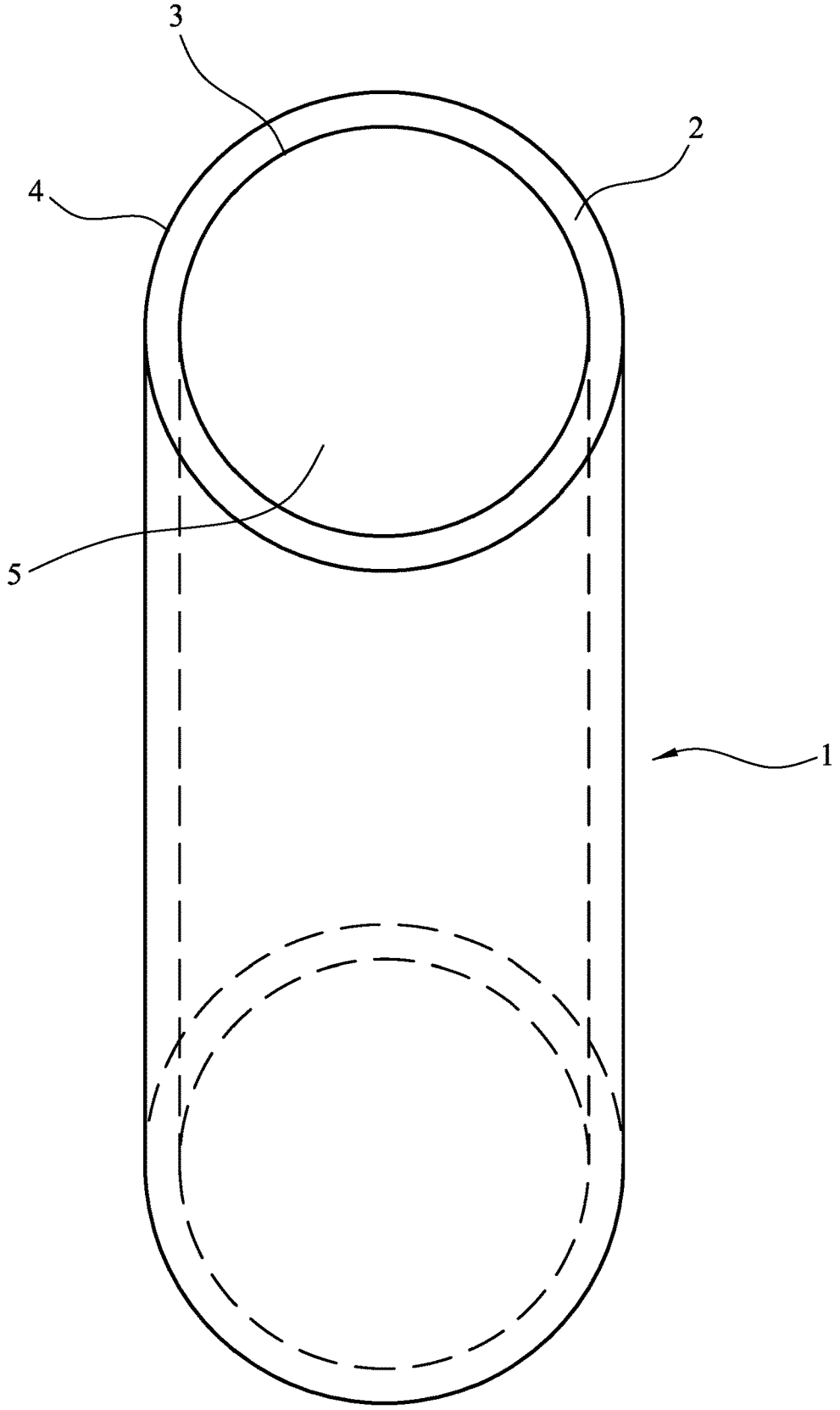

(51) Int. Cl.
*A24D 3/10* (2006.01)
*A24D 3/14* (2006.01)

(56) References Cited

U.S. PATENT DOCUMENTS

| | | | | |
|---|---|---|---|---|
| 2016/0106147 | A1* | 4/2016 | Lisan et al. ..... | A24D 3/14 |
| 2018/0338522 | A1* | 11/2018 | Delgado et al. | |
| 2019/0045838 | A1* | 2/2019 | Nappi et al. ..... | A24D 3/04 |

FOREIGN PATENT DOCUMENTS

| | | | |
|---|---|---|---|
| GB | 2347607 | A | 9/2000 |
| WO | 2014198815 | | 12/2014 |
| WO | 2017148773 | | 9/2017 |
| WO | 2017198995 | | 11/2017 |

OTHER PUBLICATIONS

Great Britain Application No. GB1721741.5, Search Report dated May 31, 2018, 5 pages.

* cited by examiner

SMOKING ARTICLE MOUTHPIECE

This application is a National Phase application under 35 U.S.C. § 371 of PCT Application No. PCT/EP2018/086196, filed Dec. 20, 2018, which application claims priority benefit to Great Britain Application No. 1721741.5, filed Dec. 22, 2017, the entire contents of which applications are hereby incorporated herein by reference.

The present invention relates to mouthpieces and/or filters, especially for cigarettes and Tobacco Heating Products.

The use of tube shaped filter elements is well known in the art. They are usually positioned at the mouth end of the smoking article to define a cavity at the mouth end. They have a number of applications, including use in conventional tobacco containing smoking articles and next generation products such as smoking articles in which the tobacco is heated rather than combusted (Tobacco Heating Products).

There are a number of benefits associated with tube shaped filter elements that have a thin wall. Thin walls provide enhanced visual characteristics. They allow for differentiation from smoking articles comprising more conventional thicker tube shaped filter elements. They also allow for premiumisation of smoking articles.

It is known to use materials such as cardboard to form tube shaped filter elements with thin walls (e.g. below 1 mm). However, such a material is prone to deformation during smoking as it becomes wet while in the user's mouth. It is also know to use cellulose acetate to form tube shaped filter elements. Conventional technologies are unable to produce a cellulose acetate filter element that has a wall thickness below approximately 1.1 mm. There is therefore a need for a cellulose acetate tube shaped filter that has a wall thickness of below 1.1 mm that can be made using existing filter making technologies and materials, allowing for consistency in the production process.

Thin walled tube shaped filter elements made from cellulose acetate have been suggested previously. Such filter elements require a relatively large amount of plasticiser (at least 22% by weight) to provide sufficient structural rigidity. Such a high level of plasticiser can be associated with quality problems in standard monoacetate filters. If too much plasticiser is applied or the concentration in one part of the filter is too high it can melt the cellulose acetate fibres, resulting in the formation of voids in the filter.

There is therefore a need for a thin walled tube shaped filter element that includes a low amount of plasticiser while maintaining the required structural rigidity. The applicants have surprisingly found that they can produce a tube shaped filter element (e.g. of circumference 16 mm to 24 mm) that has a wall thickness of 1 mm or less, having high structural rigidity while using a relatively small amount of plasticiser.

According to the present invention there is provided a mouthpiece or filter element (e.g. for use in a smoking article) comprising a longitudinally extending (e.g. cylindrical) hollow rod of (e.g. tobacco smoke) filtering material having inner and outer (e.g. substantially concentric) surfaces, the inner surface defining at least one longitudinally extending channel which extends along (e.g. through) the full length of the mouthpiece or filter element, wherein the distance between the inner and outer surfaces is 1 mm or less, wherein the (e.g. tobacco smoke) filtering material of the mouthpiece of filter element comprises a plasticiser, wherein the amount of plasticiser present in the (e.g. tobacco smoke) filtering material is from 15% to 21.5% by total weight of the (e.g. tobacco smoke) filtering material and plasticiser. Preferably the amount of plasticiser present in the (e.g. tobacco smoke) filtering material is from 15% to 20% by total weight of the (e.g. tobacco smoke) filtering material and plasticiser. Preferably the amount of plasticiser present in the (e.g. tobacco smoke) filtering material is from 15% to 19% by total weight of the (e.g. tobacco smoke) filtering material and plasticiser. Preferably the amount of plasticiser present in the (e.g. tobacco smoke) filtering material is from 18% to 21% by total weight of the (e.g. tobacco smoke) filtering material and plasticiser. Preferably the amount of plasticiser present in the (e.g. tobacco smoke) filtering material is from 18% to 20% by total weight of the (e.g. tobacco smoke) filtering material and plasticiser. Preferably the amount of plasticiser present in the (e.g. tobacco smoke) filtering material is around 19% (e.g. around 19.1%) by total weight of the (e.g. tobacco smoke) filtering material and plasticiser.

The outer circumference of the mouthpiece or filter element may be for example between 10 mm and 35 mm, for example between 12 mm and 30 mm, for example about 16 mm or about 14.5 mm. Preferably the mouthpiece or filter element has a circumference from 16 mm to 24 mm. Preferably the mouthpiece or filter element has a circumference from 22 mm to 24 mm. Preferably the mouthpiece or filter element has a circumference of around 23 mm.

The applicants have surprisingly found that they are able to produce a mouthpiece or filter element having a wall thickness (that is, the distance between the inner and outer surfaces) of less than 1 mm (e.g. 0.3 mm to 0.95 mm) comprising a relatively low amount of plasticiser (e.g. 15% to 21%) in a wide range of circumferences (e.g. 16 mm to 24 mm).

Preferably the longitudinally extending channel is surrounded by the (e.g. tobacco smoke) filtering material along the full length of the mouthpiece or filter element, and open at both ends.

According to the present invention there is provided a mouthpiece or filter element (e.g. for use in a smoking article) comprising a longitudinally extending (e.g. cylindrical) tubular rod of (e.g. tobacco smoke) filtering material having inner and outer (e.g. substantially concentric) surfaces, the inner surface of the tubular rod (of filtering material) defining at least one channel which extends along (e.g. through) the full length of the mouthpiece or filter element, wherein the distance between the inner and outer surfaces is 1 mm or less, and wherein the (e.g. tobacco smoke) filtering material of the mouthpiece or filter element comprises a plasticiser, wherein the amount of plasticiser present in the (e.g. tobacco smoke) filtering material is from 15% to 21.5% by total weight of the (e.g. tobacco smoke) filtering material and plasticiser. Preferably the longitudinally extending channel is surrounded by the filtering material along the full length of the mouthpiece or filter element, and open at both ends. Preferably the amount of plasticiser present in the (e.g. tobacco smoke) filtering material is from 15% to 20% by total weight of the (e.g. tobacco smoke) filtering material and plasticiser. Preferably the amount of plasticiser present in the (e.g. tobacco smoke) filtering material is from 15% to 19% by total weight of the (e.g. tobacco smoke) filtering material and plasticiser. Preferably the amount of plasticiser present in the (e.g. tobacco smoke) filtering material is from 18% to 21% by total weight of the (e.g. tobacco smoke) filtering material and plasticiser. Preferably the amount of plasticiser present in the (e.g. tobacco smoke) filtering material is from 18% to 20% by total weight of the (e.g. tobacco smoke) filtering material and plasticiser. Preferably the amount of plasticiser present in the (e.g.

tobacco smoke) filtering material is around 19% by total weight of the (e.g. tobacco smoke) filtering material and plasticiser.

The outer circumference of the mouthpiece or filter element may be for example between 10 mm and 35 mm, for example between 12 mm and 30 mm, for example about 16 mm or about 14.5 mm. Preferably the mouthpiece or filter element has a circumference from 16 mm to 24 mm. Preferably the mouthpiece or filter element has a circumference from 22 mm to 24 mm. Preferably the mouthpiece or filter element has a circumference of around 23 mm.

The applicants have surprisingly found that they are able to produce a mouthpiece or filter element having a wall thickness (that is, the distance between the inner and outer surfaces) of less than 1 mm (e.g. 0.3 mm to 0.95 mm) comprising a relatively low amount of plasticiser (e.g. 15% to 21%) in a wide range of circumferences (e.g. 16 mm to 24 mm).

According to the present invention there is provided a mouthpiece or filter element (e.g. for use in a smoking article) comprising a longitudinally extending (e.g. cylindrical) hollow rod of (e.g. tobacco smoke) filtering material having inner and outer (e.g. substantially concentric) surfaces, the inner surface defining at least one longitudinally extending channel which extends along (e.g. through) the full length of the mouthpiece or filter element, wherein the distance between the inner and outer surfaces is 1 mm or less, wherein the (e.g. tobacco smoke) filtering material of the mouthpiece of filter element comprises a plasticiser, wherein the amount of plasticiser present in the (e.g. tobacco smoke) filtering material is less than 17.5% by total weight of the (e.g. tobacco smoke) filtering material and plasticiser. Preferably the longitudinally extending channel is surrounded by the (e.g. tobacco smoke) filtering material along the full length of the mouthpiece or filter element, and open at both ends.

The outer circumference of the mouthpiece or filter element may be for example between 10 mm and 35 mm, for example between 12 mm and 30 mm, for example about 16 mm or about 14.5 mm. Preferably the mouthpiece or filter element has a circumference from 16 mm to 24 mm. Preferably the mouthpiece or filter element has a circumference from 22 mm to 24 mm. Preferably the mouthpiece or filter element has a circumference of around 23 mm.

The applicants have surprisingly found that they are able to produce a mouthpiece or filter element having a wall thickness (that is, the distance between the inner and outer surfaces) of less than 1 mm (e.g. 0.3 mm to 0.95 mm) comprising a relatively low amount of plasticiser in a wide range of circumferences (e.g. 16 mm to 24 mm). According to the present invention there is provided a mouthpiece or filter element (e.g. for use in a smoking article) comprising a longitudinally extending (e.g. cylindrical) tubular rod of (e.g. tobacco smoke) filtering material having inner and outer (e.g. substantially concentric) surfaces, the inner surface of the tubular rod (of filtering material) defining at least one channel which extends along (e.g. through) the full length of the mouthpiece or filter element, wherein the distance between the inner and outer surfaces is 1 mm or less, and wherein the (e.g. tobacco smoke) filtering material of the mouthpiece or filter element comprises a plasticiser, wherein the amount of plasticiser present in the (e.g. tobacco smoke) filtering material is less than 17.5% by total weight of the (e.g. tobacco smoke) filtering material and plasticiser. Preferably the longitudinally extending channel is surrounded by the filtering material along the full length of the mouthpiece or filter element, and open at both ends.

The outer circumference of the mouthpiece or filter element may be for example between 10 mm and 35 mm, for example between 12 mm and 30 mm, for example about 16 mm or about 14.5 mm. Preferably the mouthpiece or filter element has a circumference from 16 mm to 24 mm. Preferably the mouthpiece or filter element has a circumference from 22 mm to 24 mm. Preferably the mouthpiece or filter element has a circumference of around 23 mm.

The applicants have surprisingly found that they are able to produce a mouthpiece or filter element having a wall thickness (that is, the distance between the inner and outer surfaces) of less than 1 mm (e.g. 0.3 mm to 0.95 mm) comprising a relatively low amount of plasticiser in a wide range of circumferences (e.g. 16 mm to 24 mm).

The amount of plasticiser present in the mouthpiece or filter element is calculated as a percentage of the total weight of the filtering material and plasticiser via the general equation presented below. An example calculation has been presented in Example 1 wherein the mouthpiece includes an amount of plasticiser which is 17% plasticiser by total weight of the filtering material and plasticiser.

$$\text{Percentage of plasticiser \%} = \frac{\text{amount of plasticiser (g)}}{\text{amount of plasticiser (g)} + \text{amount of filtering (g)}} \times 100$$

The applicants have found that they can produce a mouthpiece or filter element that has a high structural rigidity (e.g. does not bow in production) as well as a thin wall and a low level of plasticiser. The invention can therefore be used to replace the cardboard tube used in next generation smoking articles. The thin walled mouthpiece or filter element also allows for differentiation between smoking articles and premiumisation of smoking articles.

The mouthpiece or filter element of the present invention may be incorporated into a multi-segment filter as a single segment. This would allow for an increase in the number of features that could be incorporated into the multi-segment filter. For example, a mouthpiece or filter element of the present invention may be joined with a filter element containing an additive e.g. granular additive e.g. activated carbon granules. The mouthpiece or filter element of the present invention may be joined with a filter element containing a capsule e.g. a frangible capsule, e.g. a capsule containing a flavourant. The mouthpiece or filter element of the present invention may be joined with a filter element containing a flavourant e.g. (menthol) or multiple flavourants. The mouthpiece or filter element of the present invention may be incorporated into a Tobacco Heating Product or an e-cigarette.

It will be appreciated that the mouthpiece or filter element of the present invention may be used alone as a single mouthpiece. It will be appreciated that whilst the bulk of the smoke will pass directly to the smokers mouth there will be some filtration effect from the mouthpiece because the internal side walls of the rod of filtering material will reduce the amount of mainstream smoke produced by the smoking article. Therefore, the mouthpiece of the present invention may be referred to as a filter. Thus, the mouthpiece or filter element may be used alone as a single filter.

The distance between the inner and outer surfaces of the mouthpiece or filter element may be referred to as the wall thickness. Herein, the distance between the inner and outer surfaces of the mouthpiece or filter element means this distance at its narrowest point. Thus if the mouthpiece or filter element is tubular it will have generally the same distance between the inner and outer surfaces (e.g. less than 1 mm, e.g. 0.3 mm to 0.95 mm) around the whole circumference and along its full length; in other words, if the mouthpiece or filter element is tubular it will have generally the same wall thickness (e.g. less than 1 mm, e.g. 0.3 mm to 0.95 mm) around the whole circumference and along its full length. However, if the longitudinally extending channel is "D shaped" for example the distance between the inner and outer surfaces varies around the channel.

Here the distance between the inner and outer surfaces specified in the claim will be the distance at its narrowest point.

Preferably the mouthpiece or filter element has a distance between its inner and outer (e.g. substantially concentric) surfaces that is from 0.3 mm to 0.95 mm, more preferably from 0.3 mm to 0.9 mm. More preferably the mouthpiece or filter element has a distance between its inner and outer (e.g. substantially concentric) surfaces that is from 0.5 mm to 0.8 mm, for example from 0.6 mm to 0.7 mm. Such a thin wall allows for differentiation between smoking articles and premiumisation of smoking articles. It may also be used as an anti-counterfeiting measure.

In one example the mouthpiece or filter element has an amount of plasticiser present that is from 15% to 18.3% by total weight of the filtering material and plasticiser. In another example the mouthpiece or filter element has an amount of plasticiser present that is from 18.5% to 19% by total weight of the filtering material and plasticiser. In another example the mouthpiece or filter element has an amount of plasticiser present that is from 15% to 17.9% by total weight of the filtering material and plasticiser. In another example the mouthpiece or filter element has an amount of plasticiser present that is from 18.1% to 19% by total weight of filtering and plasticiser.

The applicants have found that this low level of plasticiser improves the quality of the mouthpiece or filter element. The reduced amount of plasticiser prevents the formation of voids resulting from the plasticiser melting the cellulose acetate fibres.

It will be appreciated that the longitudinally extending rod of filtering material may be of uniform cross-section along its full length (for example, may be of uniform annular cross-section along its full length with the inner surface of the annular cross-section defining the channel).

The channel may be, for example, of circular, semi-circular (D-shaped), hollow star shaped, trilobal, pentagonal, hexagonal (see FIG. 2A), octagonal (see FIG. 2B), hollow star shaped cross section with 12 points (see FIG. 2C), hollow star shaped cross section with ten points and rounded ends (FIG. 2D) or cog-shaped cross-section, or of a cross-section in the shape of a logo or other pattern. Mouthpieces or filter elements having a non-cylindrical channel, particularly those channel filters having a complex and/or unsymmetrical cross-sectional profile may be of particular use in combatting anti-counterfeiting. Channel mouthpieces or filter elements wherein the channel is not of uniform cross-section along its full length may also be of use in combatting anti-counterfeiting.

The channel which extends the full length of the mouthpiece or filter element may be of uniform cross-section along the full length of the mouthpiece or filter element. The rod of filtering material is preferably of uniform outer dimensions along its full length (e.g. a cylinder of uniform dimensions along its full length).

According to the present invention in a further aspect there is provided a method of making a mouthpiece or filter element (e.g. for use in a smoking article) comprising a step of passing (e.g. pulling) a (e.g. tobacco smoke) filtering material to which plasticiser has been has been applied through a shaping means (e.g. a fix die) while heat treating the filtering material to thereby form a longitudinally extending (e.g. cylindrical) rod of (e.g. tobacco smoke) filtering material. The rod has inner and outer (e.g. substantially concentric) surfaces, the inner surface defining at least one longitudinally extending channel which extends along (e.g. through) the full length of the mouthpiece or filter element. The shaping means (e.g. fix die) includes a protruding inner rod (e.g. mandrel) extending through the shaping means (e.g. fix die) having a cross-sectional profile equal to that of the cross section of the longitudinally extending channel. The mandrel size (e.g. diameter) may be from 3.8 to 4.2 mm. Herein, the term "mandrel size" means the width of the mandrel at its broadest point. Thus, if the longitudinal channel is to have circular cross section, the mandrel will have a circular cross section having diameter 3.8 to 4.2 mm (depending on the desired size of the channel). The plasticiser may be applied to the tow in an amount which is from 15% to 21.5%, preferably 15% to 19% by total weight of the filtering material and plasticiser. The plasticiser may be applied to the tow in an amount which is less than 17.5% by total weight of the filtering material and plasticiser. Preferably the method includes a step wherein the (e.g. tobacco smoke) filtering material is exposed to cooling air after formation of the longitudinally extending (e.g. cylindrical) hollow rod of (e.g. tobacco smoke) filtering material. Preferably the cooling air is at temperature of 20° C. to 26° C., more preferably the cooling air is at temperature of 22° C. to 25° C., for example 22° C. to 24.5° C. Preferably the method includes a step of extending the dwell time in the cooling air (e.g. by provision of four or more air boxes through which the rod passes). The dwell time in the cooling air may be from 0.12 to 0.14 seconds, for example 0.13 seconds. The applicants have surprising found that by using a mandrel size (e.g. diameter) from 3.8 to 4.2 mm and optionally by increasing the dwell time in the cooling air (e.g. at a temperature less than 25° C.) to about 0.13 seconds that they are capable of producing a mouthpiece or filter element that has a very thin wall (e.g. 0.6 mm).

The mouthpieces or filter elements of the present invention may be produced by methods which are adaptations of those known in the art. They may be manufactured by pulling a continuous bundle of cellulose acetate filamentary tow, optionally with so triacetin already applied thereto, through a fix die having an external diameter approximately equal to that of the desired external diameter of the mouthpiece or filter element to be produced, the fix die including a protruding inner rod (or mandrel) extending through the die having a cross-sectional profile equal to that of the desired cross-section of the channel. When the filamentary tow is pulled through the die, it is passes around the inner rod such that on exiting the die, a mouthpiece or filter element is formed having a channel having a cross-sectional profile equivalent to that of the inner rod. Heated steam (that is superheated steam, as is known in the art) may be applied to the filamentary tow whilst the filamentary tow is in the die. The heated steam may be applied via a duct in the die. The heated steam cures the plasticizer applied to the filamentary tow, allowing the mouthpiece or filter element to maintain the shape of the die after exiting the die. Preferably the method includes a step wherein the (e.g. tobacco smoke) filtering material is exposed to cooling air after formation of the longitudinally extending (e.g. cylindrical) hollow rod of (e.g. tobacco smoke) filtering material. Preferably the cooling air is at temperature of 20° C. to 26° C., more preferably the cooling air is at temperature of 22° C. to 25° C., for example 22° C. to 24.5° C. Preferably the method includes a step of extending the dwell time in the cooling air (e.g. by provision of four or more air boxes through which the rod passes). The dwell time in the cooling air may be from 0.12 to 0.14 seconds, for example 0.13 seconds. The applicants have surprising found that by using a mandrel size (e.g. diameter) from 3.8 to 4.2 mm and optionally by increasing the dwell time in the cooling air (e.g. at a temperature less than 25° C.) to about 0.13 seconds that they are capable of producing a mouthpiece or filter element that has a very thin wall (e.g. 0.6 mm).

The outer circumference of the mouthpiece or filter element may be for example between 10 mm and 35 mm, for example between 12 mm and 30 mm, for example about 16 mm or about 14.5 mm. Preferably the mouthpiece or filter element has a circumference from 16 mm to 24 mm. Preferably the mouthpiece or filter element has a circumference from 22 mm to 24 mm. Preferably the mouthpiece or filter element has a circumference of around 23 mm.

The applicants have surprisingly found that they are able to produce a mouthpiece or filter element having a wall thickness (that is, the distance between the inner and outer surfaces) of less than 1 mm (e.g. 0.3 mm to 0.95 mm) comprising a relatively low amount of plasticiser (e.g. 15% to 21%) in a wide range of circumferences (e.g. 16 mm to 24 mm).

The length of the mouthpiece or filter element may be for example between 1 mm and 100 mm, for example between 5 mm and 40 mm, for example about 21 mm. Preferably, the length of the mouthpiece or filter element is between 0.5 mm and 15 mm, more preferably between 6 mm and 10 mm.

When the mouthpiece of the present invention is used as a filter for a smoking article, it will be appreciated that whilst the bulk of the smoke passes directly to the smoker's mouth, there will some filtration effect from the internal side walls as smoke passes through the mouthpiece or sits in the mouthpieces between puffs. Therefore the mouthpiece of the present invention may be termed a "filter".

The filtering material may be, for example, any of those materials (usually filamentary, fibrous, web or extruded) conventionally employed for tobacco smoke filter manufacture. The filtering material may be natural or synthetic filamentary tow, e.g. of cotton or plastics such as polyethylene or polypropylene, or cellulose acetate filamentary tow. It may be, for example, natural or synthetic staple fibres, cotton wool, web material such as paper (usually creped) and synthetic non-wovens, and extruded material (e.g. starch, synthetic foams). Preferably the filtering material comprises cellulose acetate filamentary tow. This material is moisture resistant.

The fibres (e.g. of fibre tow, e.g. cellulose acetate tow) are plasticised. In other words, the filtering material includes a plasticiser. The formation of plasticised tow is well known in the art. The plasticiser (which plasticises the fibres) may be, for example, triacetin or triethyleneglycol diacetate (TEGDA). The plasticiser may include polyethylene glycol (PEG). The fibres may be fibres of plasticised cellulose acetate tow. The fibres may be cellulose acetate tow which has been plasticised with e.g. triacetin or triethyleneglycol diacetate (TEGDA).

In mouthpieces, filters and filter elements according to aspects of the invention, the smoke filtering material may be over wrapped with a wrapper or plugwrap, for example a wrapper of paper, for example a wrapper of an air-permeable paper. Preferably the mouthpiece or filter element segment itself is not wrapped. When the mouthpiece or filter element is used as a segment in a combined rod filter it may be wrapped with a wrapper or plugwrap, for example a wrapper of paper, for example a wrapper of an air-permeable paper. Preferably the plugwrap has a weight from 20 to 50 grams per square meter, for example from 27 to 35 grams per square meter.

Any mouthpiece, filter, filter element or filter smoking article according to the invention may be unventilated, or may be ventilated by methods well known in the art, e.g. by use of a pre-perforated or air-permeable wrapper(s) (plugwrap), and/or laser perforation of wrapper(s) (plugwrap) and tipping overwrap. The mouthpiece, filter, filter element or filter smoking article according to the invention may be ventilated by laser perforation of the longitudinally extending hollow rod of (e.g. tobacco smoke) filtering material (as well as wrapper(s) (plugwrap) and tipping overwrap if present). A ventilating full tipping overwrap may likewise be inherently air-permeable or provided with ventilation holes, and in ventilated products where both filter plugwrap and tipping overwrap are present ventilation through the overwrap will usually be in register with that through the plugwrap. Ventilation holes through a filter plugwrap, or through a tipping overwrap, or through both simultaneously, may be made by laser perforation during mouthpiece, filter or filter element production.

According to the invention in a further aspect there is provided a multiple rod comprising a plurality of mouthpieces, filters or filter elements as described above and/or herein integrally joined end-to-end in a mirror image relationship.

According to the invention in a further aspect there is provided a smoking article (e.g. cigarette, e.g. Tobacco Heating Product e.g. an e-cigarette) comprising a (e.g. tobacco smoke) mouthpiece, filter or filter element according to the present invention. The mouthpiece, filter or filter element of the present invention is suitable for use with all varieties of tobacco blends.

In a filter smoking article according to one aspect of the present invention, a filter of the invention (or a filter which includes a mouthpiece or filter element of the invention) may be joined to a wrapped tobacco rod with one end of the filter towards the tobacco. The filter may be joined to the wrapped tobacco rod by ring tipping [which engages around the adjacent ends of the (wrapped) filter rod to leave much of the filter wrap exposed]. The filter may be joined by a full tipping overwrap (which engages around the full filter length and the adjacent end of the tobacco rod).

The present invention will now be illustrated by way of examples with reference to the accompanying drawing, in which:

FIG. 1 schematically illustrates a mouthpiece according to one embodiment of the present invention; and FIGS. 2A, 2B, 2C and 2D reproduce photographs of the ends of mouthpieces of four different embodiments of the invention.

EXAMPLE 1

In FIG. 1, a mouthpiece 1 comprises a longitudinally extending hollow tubular rod 2 of cellulose acetate filamentary tow, having an inner surface 3 and an outer surface 4. The tubular rod has outer circumference 16 mm. The inner surface 3 defines a longitudinally extending channel 5 of circular cross section which extends along the full length of the filter element 1. The distance between the inner surface 3 and the outer surface 4 of cylindrical tubular rod 2, that is the wall thickness of rod 2, is 0.6 mm. The cellulose acetate filamentary tow used for filter element 1 weighs 0.45 grams and also contains 0.092 grams triacetin plasticiser. The percentage of plasticiser present by total weight of the filamentary tow and triacetin plasticiser is around 17%. This has been calculated using the general equation presented earlier, to give the result below.

$$\text{Percentage of plasticiser \%} = \frac{0.092}{0.092 + 0.45} \times 100 = 17\%$$

The mouthpiece 1 of FIG. 1 is a longitudinally extending tubular rod 2 of length 6 mm and circumference 16 mm having annular cross section, the annular wall thickness being 0.6 mm.

The mouthpiece 1 of FIG. 1 may be used alone as a single element filter, or may be used as an element of a multi-segment filter. Single and multiple element filters are well known in the art.

EXAMPLE 2

The mouthpiece of the present invention (e.g. that of FIG. 1) may be produced in the following manner. A continuous bundle of cellulose acetate filamentary tow containing triacetin plasticiser (the percentage of plasticiser present by total weight of the filamentary tow and triacetin plasticiser is around 17%) is pulled through a fix die while the material is being heat treated, to form a longitudinally extending cylindrical rod of cellulose acetate tow. The rod has inner and outer substantially concentric surfaces, the inner surface defining a longitudinally extending channel which extends along the full length of the mouthpiece. The fixed die includes a protruding inner rod (mandrel) that extends through the fixed die, having a cross-sectional profile equal to that of the cross section of the longitudinally extending channel. The cellulose acetate rod is exposed to cooling air at temperature 22 to 25° C. after it is formed for an extended period of time (0.13 seconds). A mandrel of circular cross section and diameter 4.2 mm was used to form the mouthpiece of FIG. 1. These parameters result in the formation of a mouthpiece of Example 1 which has a wall thickness of 0.6 mm.

EXAMPLE 3

FIGS. 2A, 2B, 2C and 2D shows photographs of the ends of mouthpieces of four different embodiments of the invention. These were produced by methods similar to that of Example 2, with use of different protruding inner rods (mandrels) that extend through the fixed die, having different cross-sectional profiles, to provide longitudinally extending channels having different cross-sectional profiles. As will be appreciated from Example 2, the longitudinally extending channel will have the same cross section as the mandrel used.

Figure 2A:
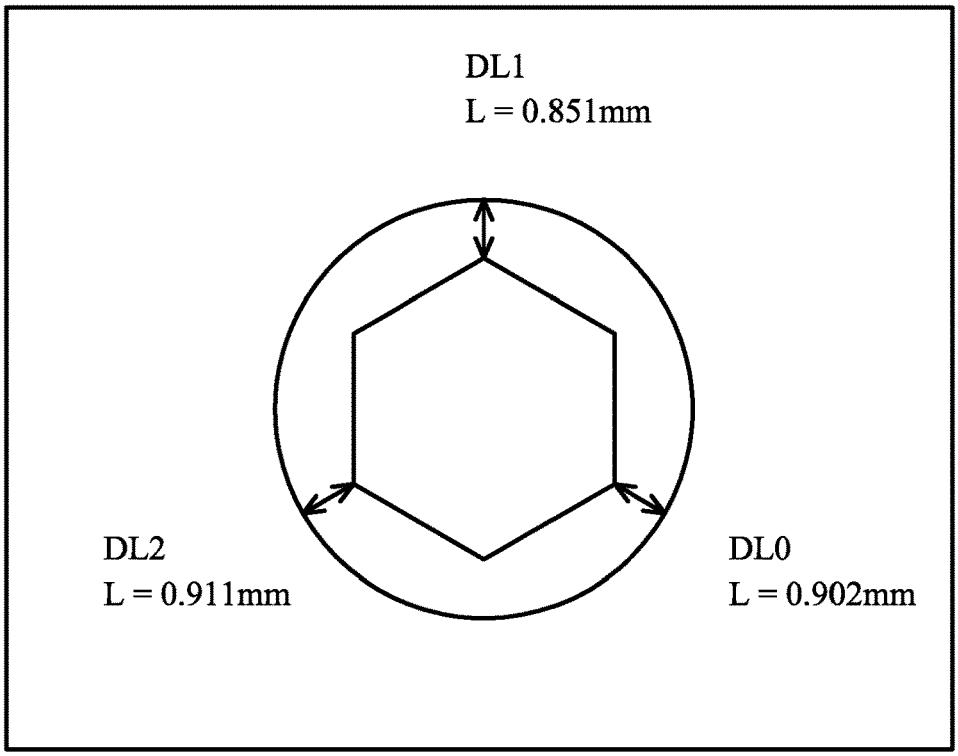

The use of a hexagonal mandrel will provide a tubular element having a longitudinally extending channel of hexagonal cross section which extends along the full length of the filter element, as shown in FIG. 2A. It can be seen that the distance between the inner and outer surfaces of the mouthpiece/element shown in FIG. 2A at its narrowest point is 0.851 mm.

Figure 2B:
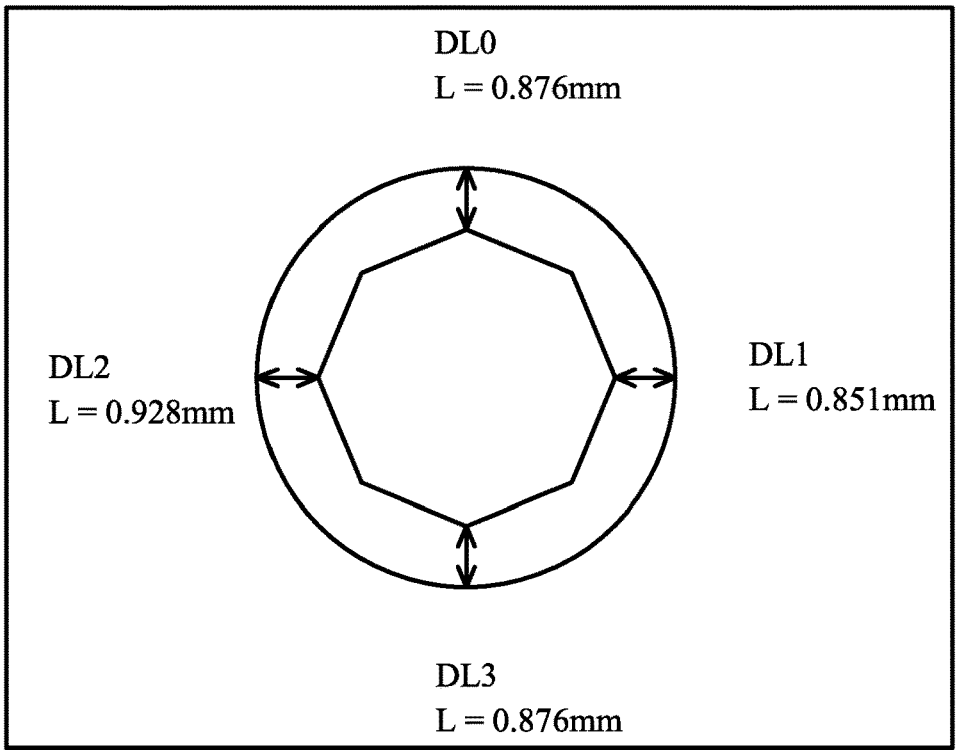

The use of an octagonal mandrel will provide a tubular element having a longitudinally extending channel of octagonal cross section which extends along the full length of the filter element, as shown in FIG. 2B. It can be seen that the distance between the inner and outer surfaces of the mouthpiece/element shown in FIG. 2B at its narrowest point is 0.851 mm.

Figure 2C:
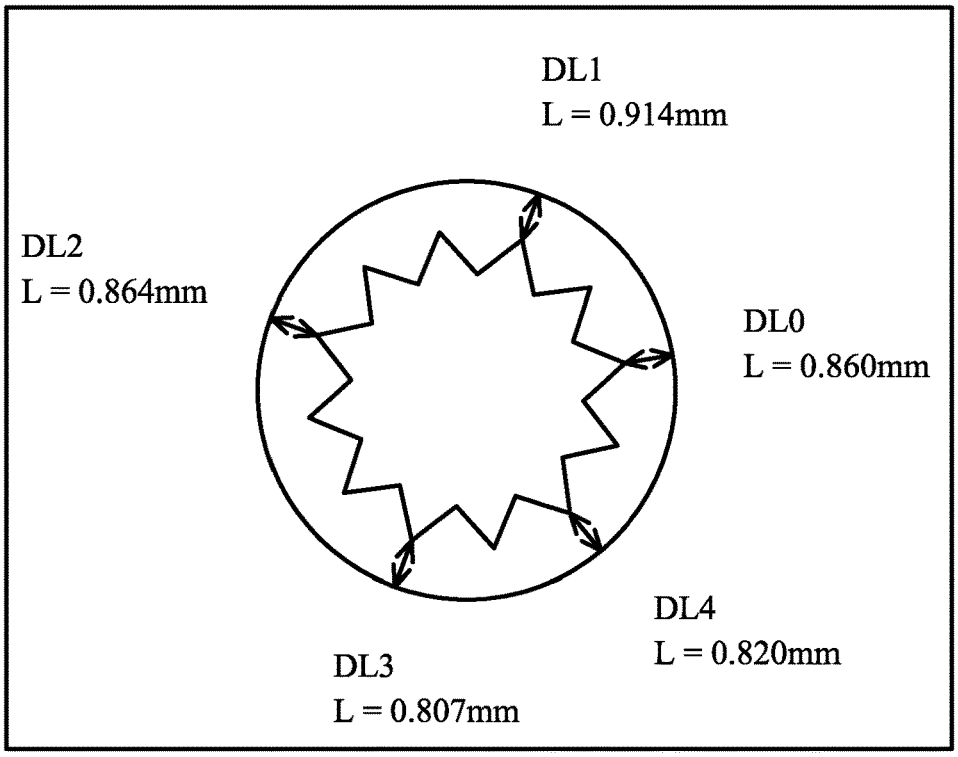

The use of a twelve point star shaped mandrel will provide a tubular element having a longitudinally extending channel of twelve point star shaped cross section which extends along the full length of the filter element, as shown in FIG. 2C. It can be seen that the distance between the inner and outer surfaces of the mouthpiece/element shown in FIG. 2C at its narrowest point—at a point of the star of the channel—is 0.807 mm.

Figure 2D:
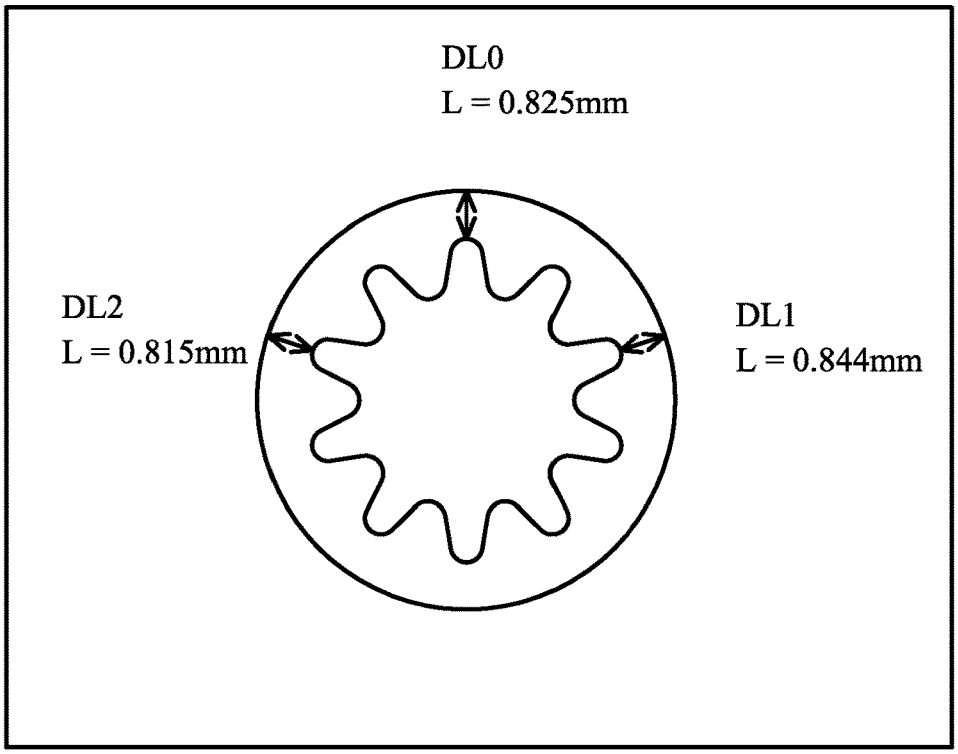

The use of a ten point (with round ends) star shaped mandrel will provide a tubular element having a longitudinally extending channel of ten point (with round ends) star shaped cross section which extends along the full length of the filter element, as shown in FIG. 2D. It can be seen that the distance between the inner and outer surfaces of the mouthpiece/element shown in FIG. 2B at its narrowest point is 0.815 mm.

FIGS. 2A, 2B, 2C and 2D illustrate that the present invention may provide mouthpieces (filters)/filter elements having walls of less than 1 mm (e.g. 0.3 mm to 0.95 mm thick) thick with longitudinally extending channels of different cross sections. The invention provides mouthpieces (filters)/filter elements with longitudinally extending channels with cross sections of very high shape definition even with very low levels of plasticiser. This high definition may be useful as an anti-counterfeit measure.

The invention claimed is:

1. A mouthpiece or filter element comprising a longitudinally extending hollow rod of filtering material having inner and outer surfaces, the inner surface defining at least one longitudinally extending channel which extends along the full length of the mouthpiece or filter element, wherein the distance between the inner and outer surfaces is 1 mm or less, wherein the filtering material of the mouthpiece or filter element comprises a plasticiser, wherein the amount of plasticiser present in the filtering material is from 15% to 19% by total weight of the filtering material and plasticiser.

2. A mouthpiece or filter element comprising a longitudinally extending hollow rod of filtering material having inner and outer surfaces, the inner surface defining at least one longitudinally extending channel which extends along the full length of the mouthpiece or filter element, wherein the distance between the inner and outer surfaces is 1 mm or less, wherein the filtering material of the mouthpiece or filter element comprises a plasticiser, wherein the amount of plasticiser present in the filtering material is less than 17.5% by total weight of the filtering material and plasticiser.

3. A mouthpiece or filter element according to claim 1 wherein the distance between the inner and outer surfaces is from 0.3 mm to 0.95 mm, preferably from 0.3 mm to 0.9 mm.

4. A mouthpiece or filter element according to claim 1 wherein the distance between the inner and outer surfaces is from 0.5 mm to 0.8 mm.

5. A mouthpiece or filter element according to claim 1 wherein the amount of plasticiser present is from 15% to 18.3% by total weight of the filtering material and plasticiser.

6. A mouthpiece or filter element according to claim 1 wherein the amount of plasticiser present is from 18.5% to 19% by total weight of the filtering material and plasticiser.

7. A mouthpiece or filter element according to claim 1 wherein the amount of plasticiser present is from 15% to 17.9% by total weight of the filtering material and plasticiser.

8. A mouthpiece or filter element according to claim 1 wherein the amount of plasticiser present is from 18.1% to 19% by total weight of filtering material and plasticiser.

9. A filter smoking article comprising a mouthpiece or filter element according to claim 1 joined at one end to a tobacco rod.

10. A filter smoking article according to claim 9 wherein the mouthpiece or filter element is wrapped by a plugwrap, the plugwrap having a weight from 20 to 50 grams per square meter.

11. A method of making a mouthpiece or filter element of claim 1, comprising a step of passing a filtering material to which a plasticiser has been applied through a shaping means while heat treating the filtering material to thereby form a longitudinally extending hollow rod of filtering material having inner and outer surfaces, the inner surface defining at least one longitudinally extending channel which extends along the full length of the mouthpiece or filter element, the shaping means including a protruding inner rod (mandrel) extending through the shaping means having a cross-sectional profile equal to that of the cross section of the longitudinally extending channel, wherein the mandrel size is substantially equal to the cross section of the longitudinally extending channel.

12. A method according to claim 11 wherein the mandrel size is from 3.8 mm to 4.2 mm.

13. A method according to claim 11 wherein the filtering material is exposed to cooling air at a temperature of less than 25° C. after formation of the longitudinally extending hollow rod of filtering material.

14. A filter smoking article according to claim 10, wherein the plugwrap has a weight from 27 to 35 grams per square meter.

15. A method according to claim 11 wherein the filtering material is exposed to cooling air at a temperature of 22° C. to 25° C. after formation of the longitudinally extending hollow rod of filtering material.

* * * * *